US006041719A

United States Patent [19]

Vidal et al.

[11] Patent Number: 6,041,719

[45] Date of Patent: Mar. 28, 2000

[54] MATERIAL HANDLING PALLET

[76] Inventors: Antione Vidal, 6 bis, rue Paul Brousse; Joseph Meynard, 14 rue Octave Mirbeau, both of F-11100 Narbonne, France

[21] Appl. No.: 09/155,737

[22] PCT Filed: Feb. 3, 1998

[86] PCT No.: PCT/FR98/00195

§ 371 Date: Nov. 6, 1998

§ 102(e) Date: Nov. 6, 1998

[87] PCT Pub. No.: WO98/33716

PCT Pub. Date: Aug. 6, 1998

[30] Foreign Application Priority Data

Feb. 3, 1997 [FR] France ..... 97 01324

[51] Int. Cl.[7] ..... B65D 19/00

[52] U.S. Cl. ..... 108/51.3; 108/56.3

[58] Field of Search ..... 108/51.11, 51.3, 108/57.17, 56.1, 56.3, 57.18, 57.19, 57.29, 64, 54.1, 346.02

[56] References Cited

U.S. PATENT DOCUMENTS

| | | | |
|---|---|---|---|
| 3,131,656 | 5/1964 | Houle | 108/56.3 X |
| 3,695,187 | 10/1972 | Weiss | 108/54.1 |
| 3,977,333 | 8/1976 | Phillips | 108/54.1 |
| 5,370,061 | 12/1994 | Kilpatrick et al. | 108/51.3 |
| 5,483,875 | 1/1996 | Turecek et al. | 108/51.3 |
| 5,490,465 | 2/1996 | Hoyt et al. | 108/51.3 |
| 5,836,254 | 11/1998 | Johansson | 108/51.3 |

FOREIGN PATENT DOCUMENTS

| | | | |
|---|---|---|---|
| 43 07 515 A1 | 9/1994 | Germany | 108/51.3 |

*Primary Examiner*—Janet M. Wilkens

*Attorney, Agent, or Firm*—Ostrolenk, Faber, Gerb & Soffen, LLP

[57] ABSTRACT

A pallet includes on the one hand a tray (1) whose upper face is for receiving the load and whose lower face is provided with longitudinal or transverse reinforcing elements (2), each bent into a U or V; and on the other, longitudinal or transverse supporting elements (3) for supporting the tray, each also bent into a U or V and fixed longitudinally or transversely to the reinforcing elements (2) by the mutual engagement of notches (20, 30) provided in the reinforcing (2) and supporting (3) elements.

11 Claims, 3 Drawing Sheets

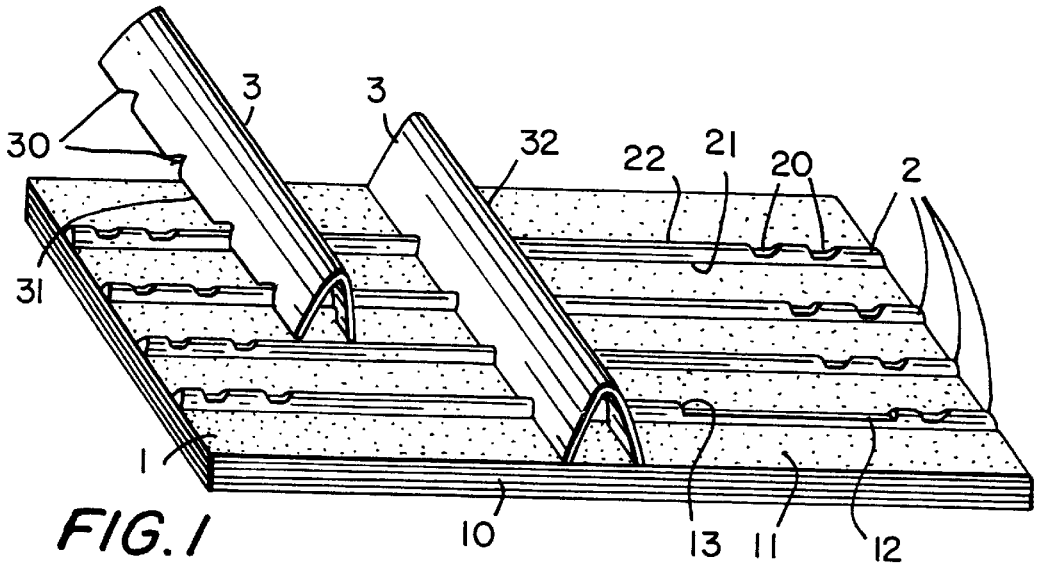
FIG. 1
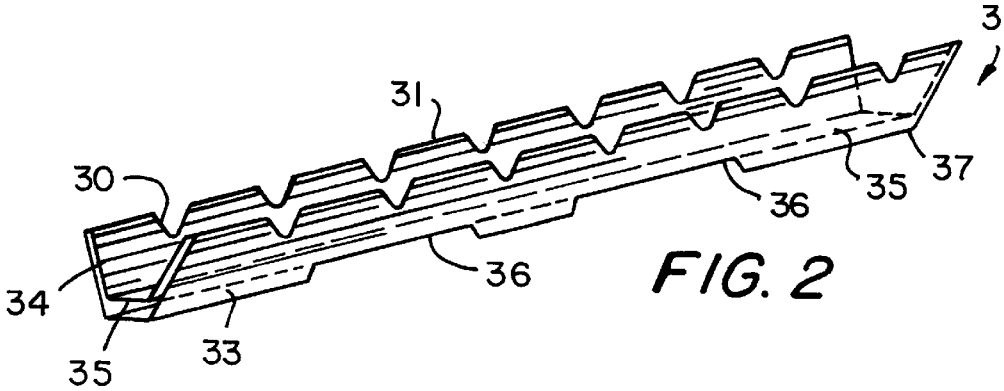
FIG. 2
FIG. 3
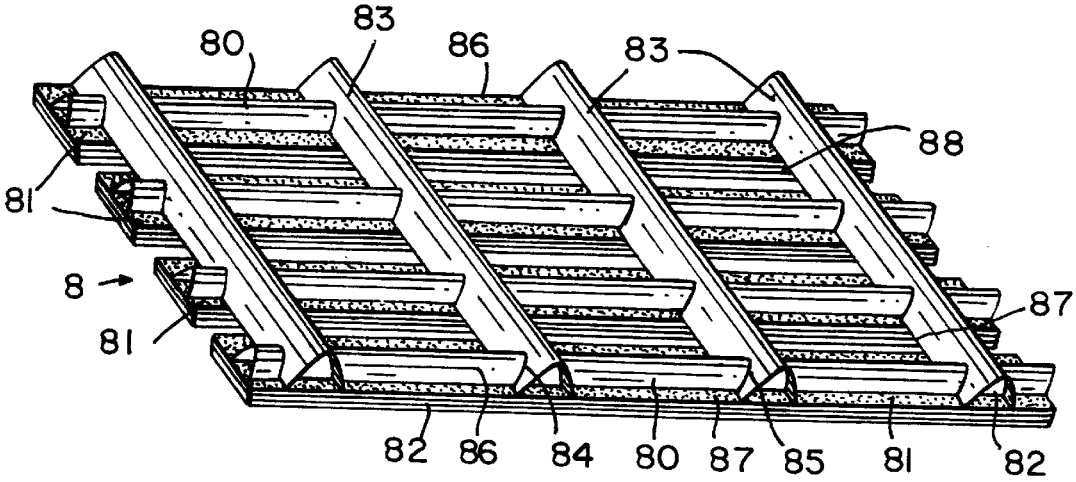

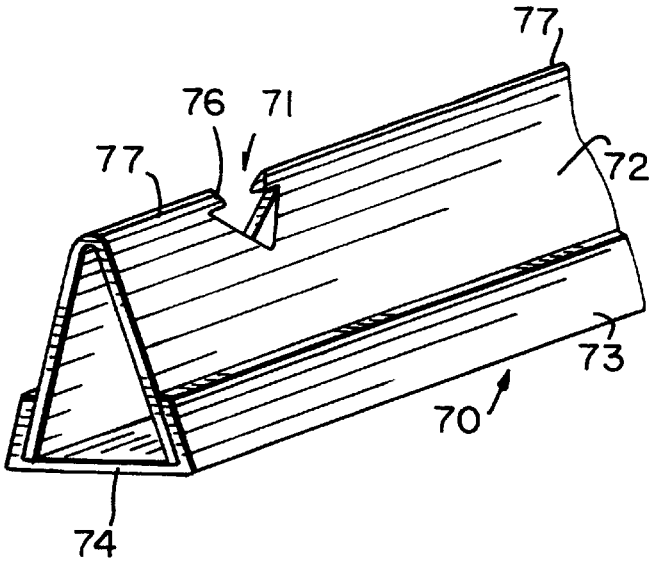
FIG. 5
FIG. 6a
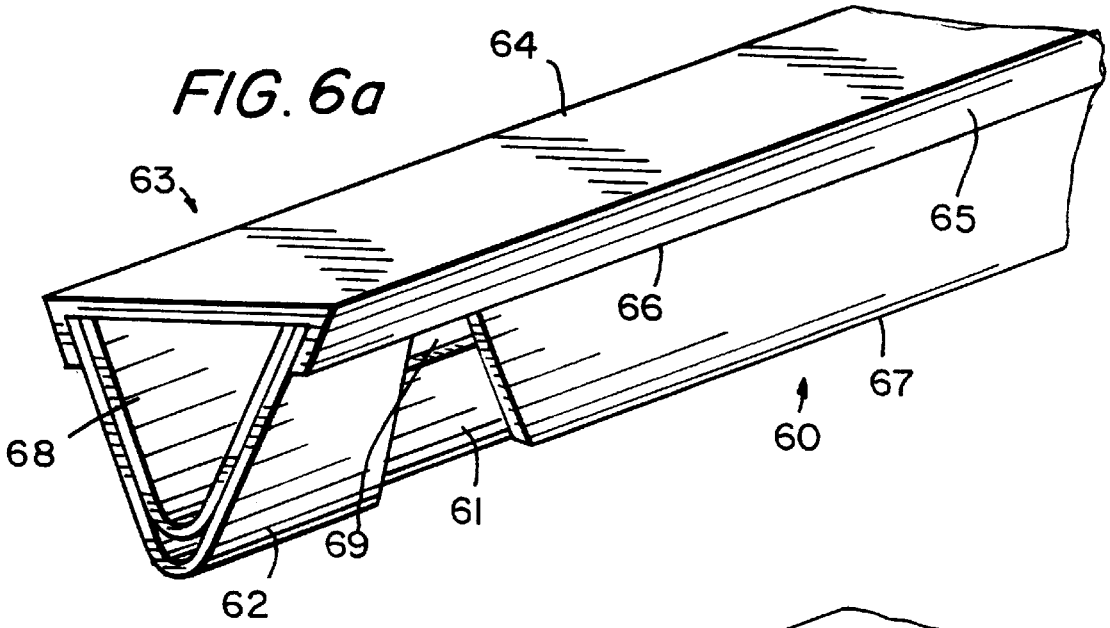
FIG. 6b
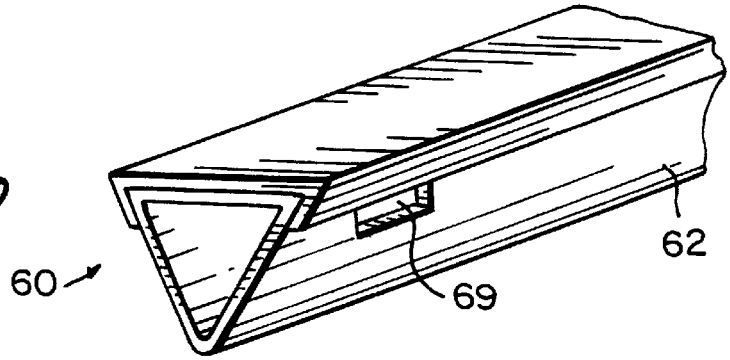

MATERIAL HANDLING PALLET

FIELD OF THE INVENTION

The present invention relates to a materials handling pallet that can be made out of board, plastic, molded wood or any other material.

BRIEF DESCRIPTION OF THE RELATED ART

Present-day materials handling pallets made out of board usually consist of lengthwise members forming the load-supporting floor and crosswise members connecting the lengthwise members parallel to each other, said lengthwise members resting directly on the ground or any other surface.

One of the problems posed by pallets of this type made from nonrigid materials concerns the strength of their component parts, and in particular the low crushing strength of the lengthwise members. As a solution to this it has been proposed that the lengthwise members be made from sheets of board folded several times to produce lengthwise members of greater strength.

However, pallets made in this way can become warped because of the fact that the different parts of which they are composed are not completely locked in position. Furthermore, the operations of bending the board sheets to form the lengthwise members, and the quantity of material they require, makes for high production costs.

SUMMARY OF THE INVENTION

The object of the present invention is to solve these drawbacks by proposing a pallet that has a good load strength and a lower production cost.

The pallet according to the invention is characterized essentially in that it comprises on the one hand a tray whose upper face is for receiving the load and whose lower face is provided with longitudinal or transverse reinforcing elements, each bent into a U or V; and on the other, longitudinal or transverse supporting elements for supporting said tray, each also bent into a U or V and fixed longitudinally or transversely to the reinforcing elements by the mutual engagement of notches provided in said reinforcing and supporting elements.

In a first embodiment of the pallet according to the invention, the reinforcing elements are attached by their longitudinal edges to the lower face of the tray and the longitudinal edges of the supporting elements are fixed to these at right angles, by the mutual engagement of notches provided on the one hand in the longitudinal edges of the supporting elements and on the other in the longitudinal fold of each reinforcing element, the pallet resting on the longitudinal folds of the supporting elements.

In this embodiment the tray can be formed from a panel of a certain thickness or from juxtaposed planks.

In a second embodiment of the pallet according to the invention, the tray consists simply of all the reinforcing elements, which are fixed to the supporting elements by mutual engagement with the aid of notches provided in the supporting elements, and of apertures provided in the reinforcing elements.

In this embodiment both the reinforcing elements and the supporting elements consist of the assembly of a first board blank bent into a U or V with a second board blank bent so that the longitudinal edges of the first blank fit into it and are covered to a certain height.

BRIEF DESCRIPTION OF THE DRAWINGS

The advantages and features of the present invention will be seen more clearly in the following description, which refers to the accompanying drawings, it being understood that this description implies no limitation on the invention.

In accompanying drawings:

FIG. 1 shows a perspective view of a materials handling pallet according to the invention in a first embodiment.

FIG. 2 shows a perspective view of a particular embodiment of the supporting elements of the pallet according to the invention, these elements being adapted to receive the fork of a lifting machine.

FIG. 3 shows a perspective view of the pallet according to the invention in a second embodiment.

FIG. 5 shows a partial perspective view of a supporting element for the pallet shown in FIG. 4.

FIGS. 6*a* and 6*b* show partial perspective views of two variants of a reinforcing element for the same pallet.

DETAILED DESCRIPTION OF THE PREFERRED EMBODIMENTS

Figure 4:
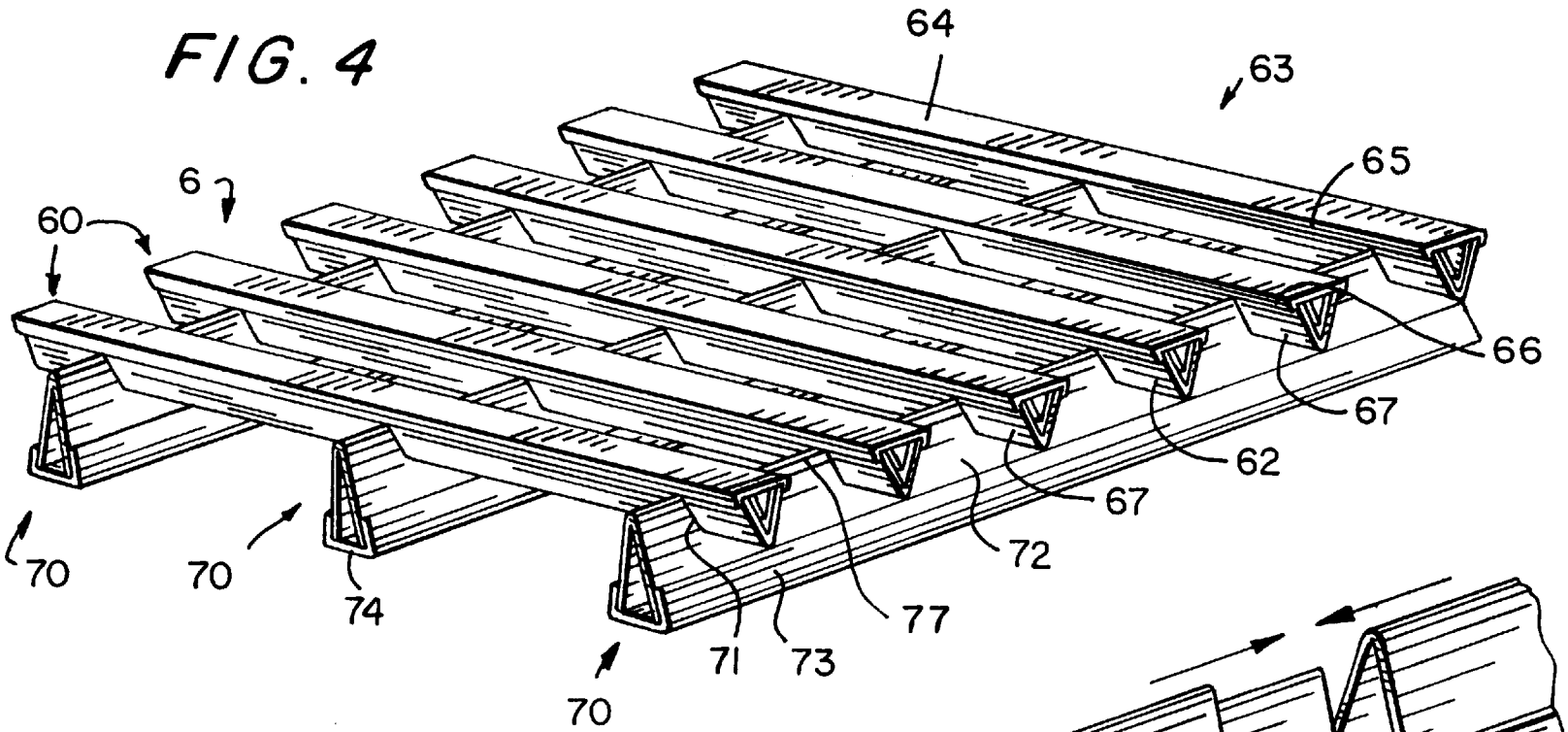
FIG. 4 shows a perspective view of the pallet according to the invention in a third embodiment.

Referring to FIG. 1, it can be seen that in a first embodiment the pallet according to the invention comprises on the one hand a tray 1, designed to support loads and consisting of a plurality of superimposed sheets of board 10 of a certain thickness joined together by adhesive bonding, and on the other a number of elements 2 providing reinforcement to the tray 1 and made from sheets of board of a certain thickness bent into a V. The reinforcing elements 2 are fixed to the lower face 11 of the tray 1 by means of regularly spaced longitudinal recesses 12, of which part of a single recess 12 is visible in the figure. The fixing of the reinforcing elements 2 is made possible by the transverse elasticity of their sides, the longitudinal edges 21 of which are wedged in the bottom of the shoulders 13 created by the recesses 12.

Also visible in FIG. 1 are the supporting elements 3 of the tray 1. The supporting elements 3 are arranged at right angles to the reinforcing elements 2 and consist of blanks of board each bent into a V and comprising notches 30 provided in their longitudinal edges 31, which notches can be engaged in notches 20 provided in the longitudinal fold 22 of each reinforcing element 2 as a means of fixing them to the latter by virtue of their transverse elasticity. The resulting pallet rests on the floor or any other surface via the longitudinal folds 32 of the supporting elements 3.

The supporting elements 3 may advantageously have a cross section in the form of a U which is more particularly suited for supporting heavy loads.

Referring to FIG. 2, this shows the supporting elements 3 which may consist of the assembly of two U-section elements 33 and 34, the one 34 engaged in the other 33, and intended to be fixed to the lower face 11 of the tray 1 via their longitudinal edges 31. The outer supporting element 33 comprises two cutouts 36 formed in its bottom 37 to allow the passage of the fork of a lifting machine. The dimensions of the inner element 34 are determined in such a way that its bottom 35 is only slightly below the upper edge of the cutouts 36, in order that the bottom 35 is not damaged when the pallet is lifted.

Referring to FIG. 3, this shows that in a second embodiment the pallet according to the invention comprises V-section reinforcing elements 80 whose longitudinal edges 87 are fixed to planks of board 81 made from assemblies of a plurality of superimposed rectangular sheets of board 82. The reinforcing elements 80 are connected together by V-section supporting elements 83 whose longitudinal edges 88 include cutouts 85 designed to engage in the cutouts 84 formed in the longitudinal fold 86 of each reinforcing element 80. The upper face of the tray 8 of the pallet is formed in this case by the upper faces of the juxtaposed, but not contiguous planks 81.

Referring to FIG. 4, this shows that in a third embodiment the pallet according to the invention comprises a tray 6 formed by V-section reinforcing elements 60 fixed to supporting elements 70 that are also V-sectioned.

The reinforcing elements 60 are fixed to the supporting elements 70 by mutual engagement with the aid of notches 71 provided in the supporting elements 70, and of apertures provided in the reinforcing elements 60.

The reinforcing elements 60 and the supporting elements 70 consist of the assembly of a first board blank 62, 72 bent into a V with a second board blank 63, 73 bent into a U, covering the first to a certain height.

The bases 74 of the second blanks 73 of the supporting elements 70 rest on the ground and may be covered with a covering or with an insulating coating, while the bases 64 of the second blanks 63 of the reinforcing elements 60 form the tray of the pallet.

In addition, to prevent deformations at the notches 71 of the supporting elements 70, the notches are formed in such a way that the longitudinal edges 66 of the arms 65 of the U of the second blanks 63 of the reinforcing elements 60 rest on the longitudinal folds 77 of the supporting elements 70 and in such a way that the longitudinal folds 67 of the reinforcing elements 60 are supported by the bases of the notches 71 formed in the supporting elements 70.

To reinforce the fixing of the supporting elements 70 and of the reinforcing elements 60, the reinforcement elements 60 may contain, as can be seen in FIG. 6*a*, a V-section third blank 68 placed against the inside face of the first blank 62 and in which apertures 69 are formed at a short distance from the ends of the arms of the U formed by the second blank 63, in alignment with notches 61 provided in the first blank 62. In this way, the inward-pointing ends 76 of the notches 71 of the supporting elements 70, visible in FIG. 5, fit into the apertures 69 and efficiently lock together the supporting elements 70 and reinforcing elements 60.

In the variant shown in FIG. 6*b* the reinforcing elements 60 comprise a single blank 62 with apertures 69 in which the inward-pointing ends 76 of the notches 71 of the supporting elements 70 engage.

Figure 7:
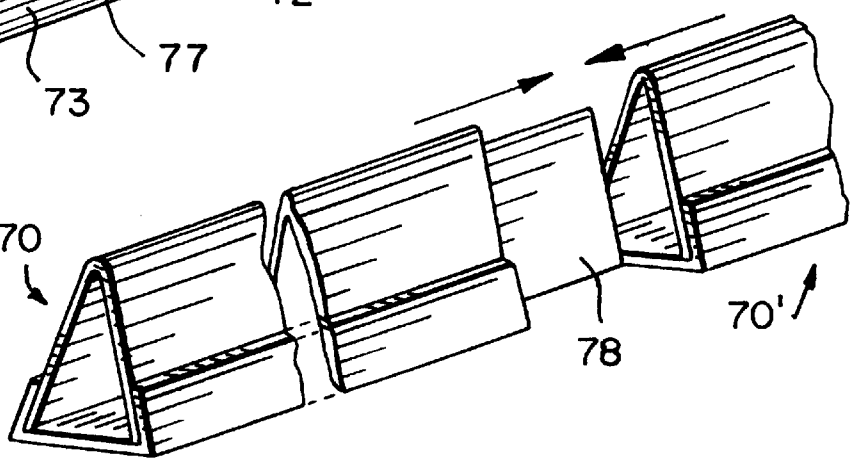
FIG. 7 shows a partial perspective view of a supporting element that includes a means for connecting two pallets together.

Referring finally to FIG. 7, this figure shows a supporting element 70 having at one end a connecting piece 78 of the same shape but of slightly smaller dimensions projecting from the supporting element 70 so that it can be assembled with another supporting element 70 of an adjoining pallet. This device allows rapid assembly of two pallets in order to create one of greater dimensions, disassembly of which is also easy and rapid.

We claim:

1. A materials handling pallet comprising:

a tray having an upper face for receiving a load and a lower face, the lower face having a plurality of regularly spaced recesses each extending across the length of the tray;

a plurality of reinforcing elements for reinforcing the tray, wherein each reinforcing element includes a first plurality of notches formed along the length thereof, and each of the reinforcing elements is fixed to the lower face of the tray in a respective one of the recesses; and a plurality of supporting elements for supporting the tray, wherein each supporting element includes a second plurality of notches formed along the length thereof, and each of the supporting elements is fixed perpendicularly to the reinforcing elements by mutual engagement of the first and second plurality of notches.

2. Pallet as claimed in claim 1, wherein each of the reinforcing elements is U or V shaped in cross-section so as to form a pair of longitudinal edges on one side and a longitudinal fold on an opposite side therefrom, the first plurality of notches being formed along the longitudinal fold of each reinforcing element, each of the reinforcing elements is fixed to the lower face of the tray with the pair of longitudinal edges disposed in the respective one of the recesses, and each of the supporting elements is U or V shaped in cross-section so as to form a pair of longitudingal edges on one side and a longitudinal fold on an opposite side therefrom, the second plurality of notches being formed along the pair of longitudinal edges of each supporting element.

3. Pallet as claimed in claim 2, wherein each of the supporting elements includes an outer element and an inner element nested inside the outer element, the outer element having cutouts along the longitudinal fold thereof having a height which is substantially defined between a level of the longitudinal fold of the outer element and a level of the longitudinal fold of the inner element, for accommodating a fork of a lifting machine.

4. Pallet as claimed in claim 1, wherein the tray is formed as a unitary panel.

5. Pallet as claimed in claim 1, wherein the tray is formed as a plurality of juxtaposed planks.

6. A materials handling pallet comprising:

a plurality of reinforcing elements positioned parallel to each other, each reinforcing element constructed from a first board blank shaped so as to have a cross-section substantially shaped as a V with a pair of longitudinal edges on one side and a longitudinal fold on a side opposite therefrom, the longitudinal fold having a first plurality of notches along the length thereof, and a second board blank shaped so as to have a cross-section substantially shaped as a U with a flattened surface and a pair of vertically extending arms, the arms having a height less than a height of the shaped first blank, wherein the second blank is capped over the first blank so that the flattened surface of the second blank covers the longitudinal edges of the first blank and the arms of the second blank are fitted over a portion of the first blank; and a plurality of supporting elements positioned parallel to each other, each supporting element constructed from a third board blank shaped so as to have a cross-section substantially shaped as a V with a pair of longitudinal edges on one side and a longitudinal fold on a side opposite therefrom, the longitudinal fold having a second plurality of notches along the length thereof, and a fourth board blank shaped so as to have a cross-section substantially shaped as a U with a flattened surface and a pair of vertically extending arms, the arms having a height less than a height of the shaped third blank, wherein the fourth blank is capped over the third blank so that the flattened surface of the fourth blank covers the longitudinal edges of the fourth blank and the arms of the fourth blank are fitted over a portion of the third blank;

wherein each of the supporting elements is fixed perpendicularly to the reinforcing elements by mutual engagement of the first and second plurality of notches, and wherein the flattened surfaces of the each of the second blanks of the reinforcing elements together form a tray.

7. Pallet as claimed in claim 6, in which the first blank of each of the reinforcing elements contains apertures situated at a short distance from the ends of the arms of the U formed by the second blank.

8. Pallet as claimed in claim 7, wherein at least one of said supporting elements has at one end a connecting piece having the same shape but of slightly smaller dimensions projecting from the supporting element so that the supporting element can be assembled with another supporting element of an adjoining pallet.

9. Pallet as claimed in claim 6, wherein the reinforcing elements each contain a fifth blank having a V-shaped cross-section placed against an inside face of the first blank and having apertures formed at a short distance from the ends of the arms of the U formed by the second blank, in alignment with the first plurality of notches provided in the first blank.

10. Pallet as claimed in claim 9, wherein at least one of said supporting elements has at one end a connecting piece having the same shape but of slightly smaller dimensions projecting from the supporting element so that the supporting element can be assembled with another supporting element of an adjoining pallet.

11. Pallet as claimed in claim 6, wherein at least one of said supporting elements has at one end of a connecting piece having the same shape but of slightly smaller dimensions projecting from the supporting element so that the supporting element can be assembled with another supporting element of an adjoining pallet.

* * * * *